US005934599A

United States Patent [19]

Hammerslag

[11] Patent Number: 5,934,599

[45] Date of Patent: Aug. 10, 1999

[54] FOOTWEAR LACING SYSTEM

[76] Inventor: Gary R. Hammerslag, 807 Amethyst Dr., Steamboat Springs, Colo. 80477

[21] Appl. No.: 08/917,056

[22] Filed: Aug. 22, 1997

[51] Int. Cl.[6] ..... A43C 7/00

[52] U.S. Cl. ..... 242/396.1; 242/396.2; 242/396.4; 36/50.5

[58] Field of Search ..... 242/395, 396.1, 242/396.2, 396.4; 36/50.5; 24/685 K, 712, 712.1, 712.2, 712.9, 713.2, 713.5, 713.6

[56] References Cited

U.S. PATENT DOCUMENTS

| | | | |
|---|---|---|---|
| 746,563 | 12/1903 | McMahon . | |
| 908,704 | 1/1909 | Sprinkle . | |
| 1,060,422 | 4/1913 | Bowdish . | |
| 1,062,511 | 5/1913 | Short | 24/712.1 |
| 1,090,438 | 3/1914 | Worth et al. | 242/382.6 |
| 1,170,472 | 2/1916 | Barber | 24/713.5 |
| 1,288,859 | 12/1918 | Feller et al. | 24/713.5 |
| 1,393,188 | 10/1921 | Whiteman . | |
| 1,412,486 | 4/1922 | Paine | 24/713.4 |
| 1,416,203 | 5/1922 | Hobson | 24/713.2 |
| 1,469,661 | 10/1923 | Migita . | |
| 1,481,903 | 1/1924 | Hart . | |
| 1,530,713 | 3/1925 | Clark . | |
| 2,109,751 | 3/1938 | Matthias et al. . | |
| 3,112,545 | 12/1963 | Williams . | |
| 3,163,900 | 1/1965 | Martin . | |
| 3,430,303 | 3/1969 | Perrin et al. | 24/712.3 |
| 4,130,949 | 12/1978 | Siedel . | |
| 4,261,081 | 4/1981 | Lott . | |
| 4,433,456 | 2/1984 | Baggio . | |
| 4,620,378 | 11/1986 | Sartor . | |
| 4,633,599 | 1/1987 | Morell et al. | 242/388.1 |
| 4,654,985 | 4/1987 | Chalmers . | |
| 4,660,300 | 4/1987 | Morell et al. | 24/68 SK |
| 4,680,878 | 7/1987 | Pozzobon et al. | 24/68 SK |
| 4,719,670 | 1/1988 | Kurt | 24/68 SK |
| 4,719,710 | 1/1988 | Pozzobon | 24/68 SK |
| 4,741,115 | 5/1988 | Pozzobon | 24/68 SK |
| 4,748,726 | 6/1988 | Schoch | 24/68 SK |
| 4,760,653 | 8/1988 | Baggio | 24/68 SK |
| 4,780,969 | 11/1988 | White, Jr. . | |
| 4,796,829 | 1/1989 | Pozzobon et al. | 242/389 |
| 4,799,297 | 1/1989 | Baggio et al. | 24/68 SK |
| 4,826,098 | 5/1989 | Pozzobon et al. | 24/68 SK |
| 4,841,649 | 6/1989 | Baggio et al. | 24/68 SK |
| 4,870,761 | 10/1989 | Tracy | 24/712 |
| 4,884,760 | 12/1989 | Baggio et al. | 24/68 SK |
| 4,961,544 | 10/1990 | Bidoia | 24/68 SK |
| 5,001,817 | 3/1991 | De Bortoli et al. | 24/68 SK |
| 5,016,327 | 5/1991 | Klausner . | |
| 5,062,225 | 11/1991 | Gorza | 24/68 SK |
| 5,065,480 | 11/1991 | De Bortoli | 24/68 SK |
| 5,065,481 | 11/1991 | Walkhoff | 24/68 SK |
| 5,152,038 | 10/1992 | Schoch | 24/68 SK |
| 5,157,813 | 10/1992 | Carroll | 24/68 SK |
| 5,181,331 | 1/1993 | Berger | 36/50.5 |
| 5,184,378 | 2/1993 | Batra . | |
| 5,249,377 | 10/1993 | Walkhoff . | |
| 5,259,094 | 11/1993 | Zepeda . | |
| 5,315,741 | 5/1994 | Dubberke | 24/712.1 |

(List continued on next page.)

FOREIGN PATENT DOCUMENTS 11673 6/1899 United Kingdom .

OTHER PUBLICATIONS

ASOLO® Boot Brochure/Catalog, undated.

*Primary Examiner*—John P. Darling
*Attorney, Agent, or Firm*—Knobbe, Martens, Olson & Bear, LLP

[57] ABSTRACT

A footwear lacing system comprises a lace attached to a tightening mechanism. The lace is threaded through a series of opposing guide members positioned along the top of the foot and ankle portions of the footwear. The lace and guide preferably have low friction surfaces to facilitate sliding of the lace through the guide members so that the lace evenly distributes tension across the footwear member. The tightening mechanism allows incremental adjustment of the tension of the lace. A release mechanism allows a user to quickly loosen the lace.

10 Claims, 4 Drawing Sheets

U.S. PATENT DOCUMENTS

| | | | |
|---|---|---|---|
| 5,325,613 | 7/1994 | Sussmann | 36/50.5 |
| 5,335,401 | 8/1994 | Hanson | 24/712.5 |
| 5,345,697 | 9/1994 | Quellais . | |
| 5,477,593 | 12/1995 | Leick | 24/712.5 |
| 5,557,864 | 9/1996 | Marks | 36/50.5 |
| 5,566,474 | 10/1996 | Leick et al. | 36/50.5 |
| 5,600,874 | 2/1997 | Jungkind | 24/68 SK |
| 5,606,778 | 3/1997 | Jungkind | 24/68 SK |
| 5,640,785 | 6/1997 | Egelja | 24/712 |
| 5,647,104 | 7/1997 | James | 24/68 SK |
| 5,718,021 | 2/1998 | Tatum | 24/712.2 |
| 5,732,483 | 3/1998 | Cagliari | 36/50.5 |

FOOTWEAR LACING SYSTEM

The present invention relates to footwear. More particularly, the present invention relates to a low-friction lacing system that provides equilibrated tightening pressure across a wearer's foot for sports boots and shoes.

BACKGROUND OF THE INVENTION

There currently exists a number of mechanisms and methods for tightening a shoe or boot around a wearer's foot. A traditional method comprises threading a lace in a zig-zag pattern through eyelets that run in two parallel rows attached to opposite sides of the shoe. The shoe is tightened by first tensioning opposite ends of the threaded lace to pull the two rows of eyelets towards the midline of the foot and then tying the ends in a knot to maintain the tension. A number of drawbacks are associated with this type of lacing system. First, laces do not adequately distribute the tightening force along the length of the threaded zone, due to friction between the lace and the eyelets, so that portions of the lace are slack and other portions are in tension. Consequently, the higher tensioned portions of the shoe are tighter around certain sections of the foot, particularly the ankle portions which are closer to the lace ends. This is uncomfortable and can adversely affect performance in some sports.

Another drawback associated with conventional laces is that it is often difficult to untighten or redistribute tension on the lace, as the wearer must loosen the lace from each of the many eyelets through which the laces are threaded. The lace is not easily released by simply untightening the knot. The friction between the lace and the eyelets often maintains the toe portions and sometimes much of the foot in tension even when the knot is released. Consequently, the user must often loosen the lace individually from each of the eyelets. This is especially tedious if the number of eyelets is high, such as in ice-skating boots or other specialized high performance footwear.

Another tightening mechanism comprises buckles which clamp together to tighten the shoe around the wearer's foot. Typically, three to four or more buckles are positioned over the upper portion of the shoe. The buckles may be quickly clamped together and drawn apart to tighten and loosen the shoe around the wearer's foot. Although buckles may be easily and quickly tightened and untightened, they also have certain drawbacks. Specifically, buckles isolate the closure pressure across three or four points along the wearer's foot corresponding to the locations of the buckles. This is undesirable in many circumstances, such as for the use of sport boots where the wearer desires a force line that is evenly distributed along the length of the foot. Another drawback of buckles is that they are typically only useful for hard plastic or other rigid material boots. Buckles are not as practical for use with softer boots, such as ice skates or snowboard boots.

There is therefore a need for a tightening system for footwear that does not suffer from the aforementioned drawbacks. Such a system should automatically distribute lateral tightening forces along the length of the wearer's ankle and foot. The tightness of the shoe should desirably be easy to loosen and incrementally adjust. The tightening system should close tightly and should not loosen up with continued use.

SUMMARY OF THE INVENTION

There is provided in accordance with one aspect of the present invention a footwear lacing system. The lacing system comprises a footwear member including a first and second opposing closure flaps configured to fit around a foot. A plurality of tubular guide members are positioned on the closure flaps, the guide members having a low friction interior surface. A low friction lace extends through the guide members, the low friction lace having first and second ends attached to a spool. A tightening mechanism is attached to the footwear member and coupled to the spool, the tightening mechanism having a control for incrementally winding the lace around the spool to place the lace in tension, and a release is provided for releasing tension on the spool.

In accordance with another aspect of the present invention, there is provided a tightening system for a boot having closure flaps, the tightening system comprising a plurality of tubular guide members positioned on opposed edges of the closure flaps. The guide members are manufactured of a low friction material, and a low friction lace is threaded through the guide members. A tightening mechanism is provided to permit tensioning of the lace, and a release mechanism is provided for releasing tension on the lace.

In accordance with a further aspect of the present invention, there is provided a method of balancing tension along the length of a lacing zone in boot. The method comprises the steps of providing a boot having a first and second opposed sets of guide members, and a lace extending back and forth between the first and second opposed guide members. The guide members and the lace have a relatively low friction interface between them. A rotatable tightening mechanism is provided on the boot for retracting lace thereby advancing the first and second set of opposed guide members towards each other to tighten the boot. The control is rotated to retract lace, thereby advancing the first and second opposing sets of guide members towards each other to tighten the boot, and the laces is permitted to slide through the guide members, to equilibrate tightening force along the length of the lacing zone on the boot.

Further features and advantages of the present invention will become apparent from the detailed description of preferred embodiments which follows, when considered together with the attached drawings and claims.

DETAILED DESCRIPTION OF PREFERRED EMBODIMENTS

Figure 1:
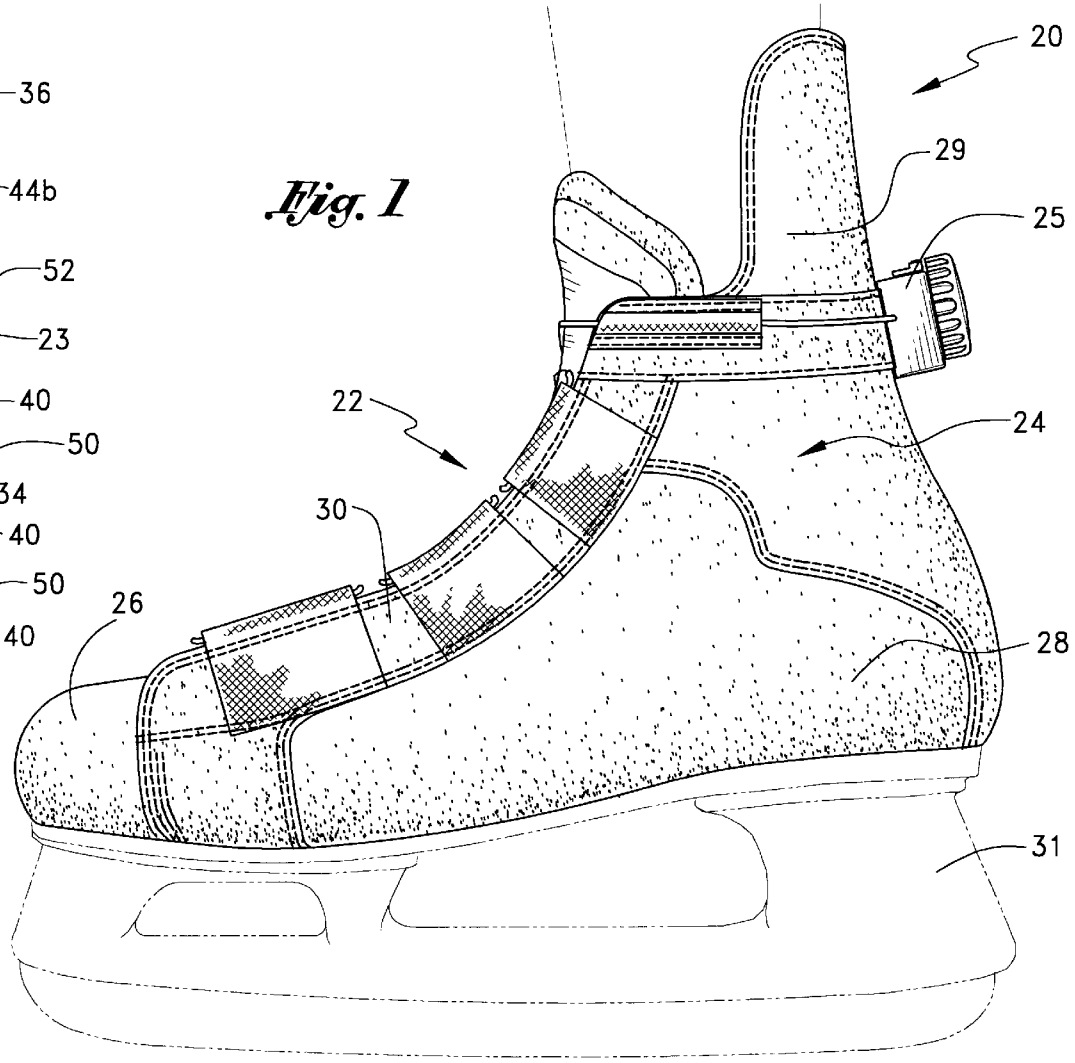
FIG. 1 is a side view of a sport boot including a lacing system configured in accordance with the present invention.

Referring to FIG. 1, there is disclosed one embodiment of a sport boot 20 prepared in accordance with the present invention. The sport boot 20 generally comprises an ice skating or other action sport boot which is tightened around a wearer's foot using a lacing system 22. The lacing system 22 includes a lace 23 (FIG. 2) that is threaded through the boot 20 and attached at opposite ends to a tightening mechanism 25, as described in detail below. The lace 23 is a low friction lace that slides easily through the boot 20 and automatically equilibrates tightening of the boot 20 over the length of the lacing zone, which generally extends along the ankle and foot. Although the present invention will be described with reference to an ice skating boot, it is to be understood that the principles discussed herein are readily applicable to any of a wide variety of footwear, and are particularly applicable to sports shoes or boots suitable for snow boarding, roller skating, skiing and the like.

The boot 20 includes an upper 24 comprising a toe portion 26, a heel portion 28, and an ankle portion 29 that surrounds the wearer's ankle. An instep portion 30 of the upper 24 is interposed between the toe portion 26 and the ankle portion 29. The instep portion 30 is configured to fit around the upper part of the arch of the medial side of the wearer's foot between the ankle and the toes. A blade 31 (shown in phantom lines) extends downward from the bottom of the boot 20 in an ice-skating embodiment.

Figure 2:
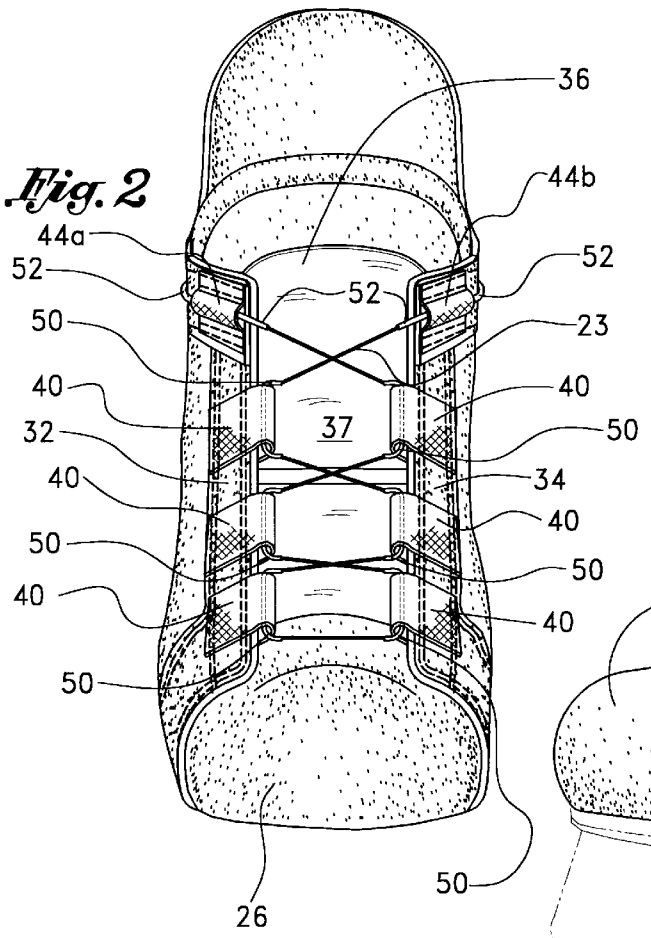
FIG. 2 is a front view of the sport boot of FIG. 1.

FIG. 2 is a front elevational view of the boot 20. As shown, the top of the boot 20 generally comprises two opposed closure edges or flaps 32 and 34 that partially cover a tongue 36. Generally, the lace 23 may be tensioned to draw the flaps 32 and 34 toward each other and tighten the boot 20 around the foot, as described in detail below. Although the inner edges of the flaps 32 and 34 are shown separated by a distance, it is understood that the flaps 32 and 34 could also be sized to overlap each other when the boot 20 is tightened, such as is known with ski footwear.

Referring to FIG. 2, the tongue 36 extends rearwardly from the toe portion 26 toward the ankle portion 29 of the boot 20. Preferably, the tongue 36 is provided with a low friction top surface 37 to facilitate sliding of the flaps 32 and 34 and lace 23 over the surface of the tongue 32 when the lace 23 is tightened. The low friction surface 37 may be formed integrally with the tongue 32 or applied thereto such as by adhesives, heat bonding, stitching or the like. In one embodiment, the surface 37 is formed by adhering a flexible layer of nylon or polytetrafluoroethylene to the top surface of the tongue 36. The tongue 36 is preferably manufactured of a soft material, such as leather.

The upper 24 may be manufactured from any from a wide variety of materials known to those skilled in the art. In the case of a snow board boot, the upper 24 is preferably manufactured from a soft leather material that conforms to the shape of the wearer's foot. For other types of boots or shoes, the upper 24 may be manufactured of a hard or soft plastic. It is also contemplated that the upper 24 could be manufactured from any of a variety of other known materials.

As shown in FIG. 2, the lace 23 is threaded in a crossing pattern along the midline of the foot between two generally parallel rows of side retaining members 40 located on the flaps 32 and 34. In the illustrated embodiment, the side retaining members 40 each consist of a strip of material looped around the top and bottom edges of the flaps 32 and 34 so as to define a space in which guides 50 are positioned. The lace 23 slides through the guides 50 during tightening and untightening of the lace 23, as described more fully below. In the illustrated embodiment, there are three side retaining members 40 on each flap 32, 34 although the number of retaining members 40 may vary. In some embodiments, four, five or six or more retaining members 40 may be desirable on each side of the boot.

The guides 50 may be attached to the flaps 32 and 34 or to other spaced apart portions of the shoe through any of a variety of manners, as will be appreciated by those of skill in the art in view of the disclosure herein. For example, the retaining members 40 can be deleted and the guide 50 sewn directly onto the surface of the flap 32 or 34 or opposing sides of the upper. Stitching the guide 50 directly to the flap 32 or 34 may advantageously permit optimal control over the force distribution along the length of the guide 50. For example, when the lace 23 is under relatively high levels of tension, the guide 50 may tend to want to bend and to possibly even kink near the curved transition in between longitudinal portion 51 and transverse portion 53 as will be discussed. Bending of the guide member under tension may increase friction between the guide member and the lace 23, and, severe bending or kinking of the guide member 50 may undesirably interfere with the intended operation of the lacing system. Thus, the attachment mechanism for attaching the guide member 50 to the shoe preferably provides sufficient support of the guide member to resist bending and/or kinking. Sufficient support is particularly desirable on the inside radius of any curved portions particularly near the ends of the guide member 50.

As shown in FIGS. 1 and 2, the lace 23 also extends around the ankle portion 29 through a pair of upper retaining members 44*a* and 44*b* located on the ankle portion 29. The upper retaining members 44*a* and 44*b* each comprise a strip of material having a partially raised central portion that defines a space between the retaining members 44 and the upper 24. An upper guide member 52 extends through each of the spaces for guiding the lace 23 around either side of the ankle portion 29 to the tightening mechanism 25.

Figure 3:
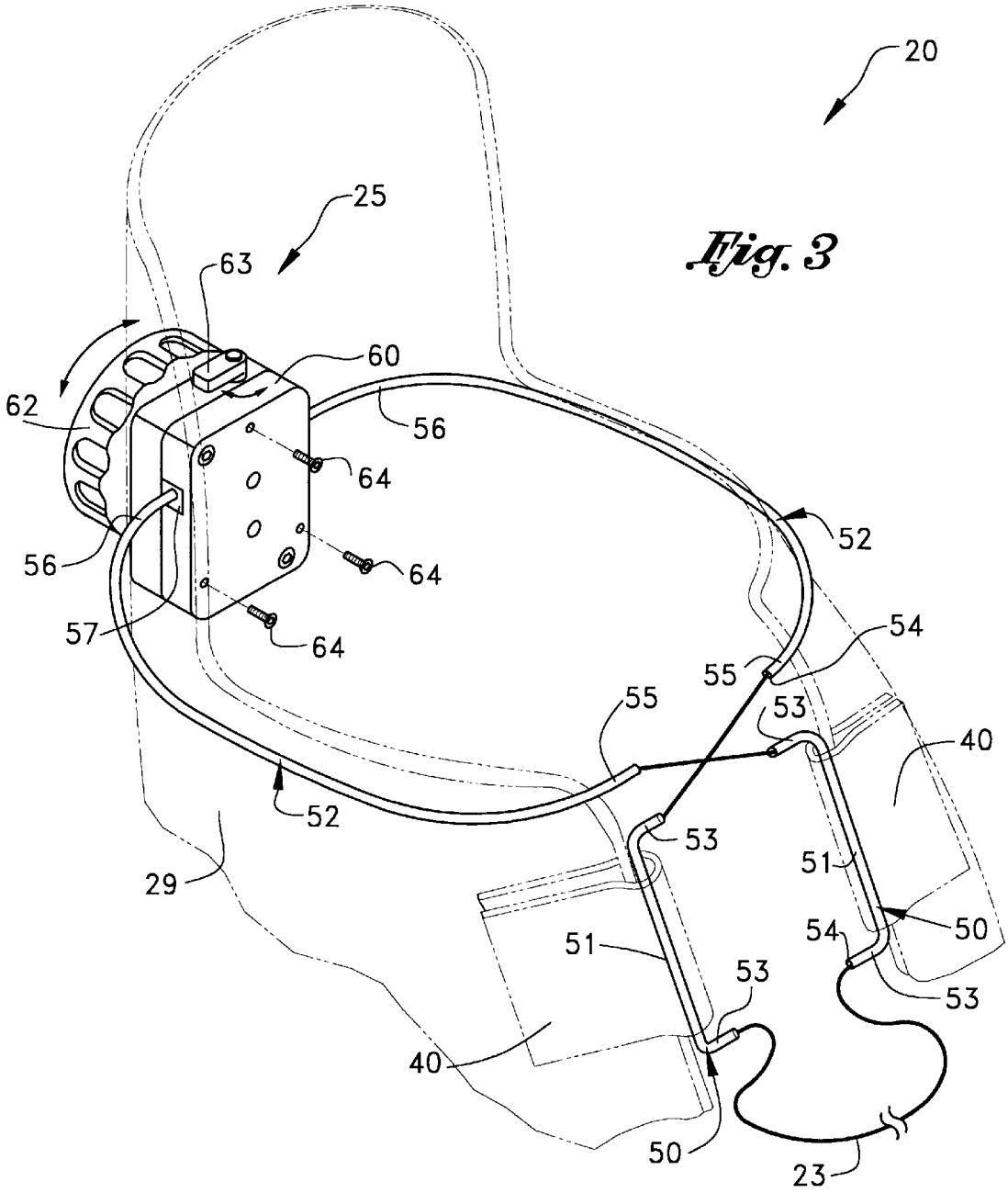
FIG. 3 is a perspective schematic view of the lacing system of the sport boot of FIG. 1.

FIG. 3 is a schematic perspective view of the lacing system 22 of the boot 20. As shown, each of the side and top guide members 50 and 52, has a tube-like configuration having a central lumen 54. Each lumen 54 has an inside diameter that is larger than the outside diameter of the lace 23 to facilitate sliding of the lace 23 through the side and top guide members 50, 52 and prevent binding of the lace 23 during tightening and untightening. In one embodiment, the inside diameter of the lumen is approximately 0.040 inches, to cooperate with a lace having an outside diameter of about 0.027". However, it will be appreciated that the diameter of the lumen 54 can be varied to fit specific desired lace dimensions and other design considerations.

In the illustrated embodiment, the side guide members 50 each have a generally U-shape that opens towards the midline of the shoe. Preferably, each of the side guide members 50 comprise a longitudinal portion 51 and two inclined or transverse portions 53 extending therefrom. The length of the longitudinal portion 51 may be varied to adjust the distribution of the closing pressure that the lace 23 applies to the upper 24 when the lace 23 is under tension. In addition, the length of the longitudinal portion 51 need not be the same for all guide members 50 on a particular shoe. For example, the longitudinal portion 51 may be shortened near the ankle portion 29 to increase the closing pressure that the lace 23 applies to the ankles of the wearer. In general, the length of the longitudinal portion 51 will fall within the range of from about ½" to about 3", and, in some embodiments, within the range of from about ¼" to about 4". In one snowboard application, the longitudinal portion 51 had a length of about 2". The length of the transverse portion 53 is generally within the range of from about ⅛" to about 1". In one snowboard embodiment, the length of transverse portion 53 was about ½". Different specific length combinations can be readily optimized for a particular boot design through routine experimentation by one of ordinary skill in the art in view of the disclosure herein.

In between the longitudinal portion 51 and transverse portion 53 is a curved transition. Preferably, the transition has a substantially uniform radius throughout, or smooth progressive curve without any abrupt edges or sharp changes in radius. This construction provides a smooth surface over which the lace 23 can slide, as it rounds the corner. The transverse section 53 can in some embodiments be deleted, as long as a rounded cornering surface if provided to facilitate sliding of the lace 23. In an embodiment which has a transverse section 53 and a radiused transition, with a guide member 50 having an outside diameter of 0.090" and a lace 23 having an outside diameter of 0.027", the radius of the transition is preferably greater than about 0.1", and generally within the range of from about 0.125" to about 0.4".

Referring to FIG. 3, the upper guide members 52 extend substantially around opposite sides of the ankle portion 29. Each upper guide member 52 has a proximal end 56 and a distal end 55. The distal ends 55 are positioned near the top of the tongue 36 for receipt of the lace 23 from the uppermost side guide members 50. The proximal ends 56 are coupled to the tightening mechanism 25. In the illustrated embodiment, the proximal ends 56 include rectangular coupling mounts 57 that engage with the tightening mechanism 25 for feeding the ends of the lace 23 therein, as described more fully below.

The guide members 50, 52 are preferably manufactured of a low friction material, such as a lubricous polymer or metal, that facilitates the slidability of the lace 23 therethrough. Alternatively, the guides 50, 52 can be made from any convenient substantially rigid material, and then be provided with a lubricous coating on at least the inside surface of lumen 54 to enhance slidability. The guide members 50 and 52 are preferably substantially rigid to prevent bending and kinking of the guide members 50, 52 and/or the lace 23 within any of the guide members 50 and 52 as the lace 23 is tightened. The guide members 50, 52 may be manufactured from straight tube of material that is cold bent or heated and bent to a desired shape.

Alternatively, the guide members 50, 52 may be constructed in a manner that permits bending, retains a low friction surface, yet resist kinking. For example, guide members 50, 52 may comprise a spring coil, either with the spring coil exposed or the spring coil provided with a polymeric coating on the inside surface or outside surface or both. The provision of a spring coil guide satisfies the need for lateral flexibility in some embodiments, yet retains a hard interior surface which help to minimize friction between the guide and the lace.

As an alternate guide member 50, 52 design which increases lateral flexibility yet retains a hard interior lace contacting surface, the guide 50 may comprise a plurality of coaxially-aligned segments of a hard polymeric or metal tube material. Thus, a plurality of tubing segments, each segment having an axial length within the range of from about 0.1" to about 1.0", and preferably about 0.25" or less can be coaxially aligned, either in end-to-end contact or axially spaced apart along the length of the guide 50, 52. Adjacent tubular segments can be maintained in a coaxial relationship such as by the provision of an outer flexible polymeric jacket. The shape of the tubular guide may be retained such as by stitching the guide onto the side of the shoe in the desired orientation, or through other techniques which will be apparent to those of skill in the art in view of the disclosure herein.

As an alternative to the previously described tubular guide members, the guide members 50, 52 comprise an open channel having, for example, a semicircular or "U" shaped cross section. The guide channel is preferably mounted on the boot such that the channel opening faces away from the midline of the boot, so that a lace under tension will be retained therein. One or more retention strips, stitches or flaps may be provided for "closing" the open side of the channel, to prevent the lace from escaping when tension on the lace is released. The axial length of the channel can be preformed in a generally U configuration like the illustrated tubular embodiment, and may be continuous or segmented as described in connection with the tubular embodiment.

Several guide channels may be molded as a single piece, such as several guide channels molded to a common backing support strip which can be adhered or stitched to the shoe. Thus, a right lace retainer strip and a left lace retainer strip can be secured to opposing portions of the top or sides of the shoe to provide a right set of guide channels and a left set of guide channels.

The lace 23 may be formed from any of a wide variety of polymeric or metal materials or combinations thereof, which exhibit sufficient axial strength and bendability for the present application. For example, any of a wide variety of solid core wires, solid core polymers, or multi-filament wires or polymers, which may be woven, braided, twisted or otherwise oriented can be used. A solid or multi-filament metal core can be provided with a polymeric coating, such as PTFE or others known in the art, to reduce friction. In one embodiment, the lace 23 comprises a stranded cable, such as a 7 strand by 7 strand cable manufactured of stainless steel. In order to reduce friction between the lace 23 and the guide members 50, 52 through which the lace 23 slides, the outer surface of the lace 23 is preferably coated with a lubricous material, such as nylon or Teflon. In a preferred embodiment, the diameter of the lace 23 ranges from 0.024 inches to 0.060 inches and is preferably 0.027 inches. The lace 23 is desirably strong enough to withstand loads of at least 40 pounds and preferably loads up to 90 pounds. A lace 23 of at least five feet in length is suitable for most footwear sizes, although smaller or larger lengths could be used depending upon the lacing system design.

As shown in FIG. 3, the tightening mechanism 25 is mounted to the rear of the upper 24 by fasteners 64. Although the tightening mechanism 25 is shown mounted to the rear of the boot 20, it is understood that the tightening mechanism 25 could be located at any of a wide variety of locations on the boot 20. In the case of an ice skating boot, the tightening mechanism is preferably positioned over a top portion of the tongue 36. The tightening mechanism 25 may alternatively be located on the bottom of the heal of the boot, on the medial or the lateral sides of the upper or sole, as well as anywhere along the midline of the shoe facing forward or upward. Location of the tightening mechanism 25 may be optimized in view of a variety of considerations, such as overall boot design as well as the intended use of the boot.

The shape and overall volume of the tightening mechanism 25 can be varied widely, depending upon the gear train design, and the desired end use and location on the boot. A relatively low profile tightening mechanism 25 is generally preferred. The mounted profile of the tightening mechanism 25 can be further reduced by recessing the tightening mechanism 25 into the wall or tongue of the boot. Boots for many applications have a relatively thick wall, such as due to structural support and/or thermal insulation and comfort requirements. The tightening mechanism may be recessed into the wall of the boot by as much as ¾" or more in some locations and for some boots, or on the order of about ⅛" or ½" for other location and/or other boots, without adversely impacting the comfort and functionality of the boot.

In general, the tightening mechanism 25 comprises a control such as a lever, crank or knob, which can be manipulated to retract lace 23 therein. In addition, the tightening mechanism preferably comprises a release such as a button or lever, for disengaging the tightening mechanism to permit the lace 23 to be withdrawn freely therefrom.

The tightening mechanism 25 in the illustrated embodiment generally comprises a rectangular housing 60 and a circular knob 62 rotatably mounted thereto. The knob 62 may be rotated to wind the ends of the lace 23 into the housing 60 and thereby tension the lace 23 to reduce slack. As the slack in the lace 23 reduces, the lace 23 pulls the side guide members 50, and thereby the flaps 32 and 34, toward the midline of the boot to tighten the upper 24 around a foot.

The tightening mechanism 25 advantageously includes an internal gear mechanism to allow the wearer to easily turn the knob 62 to retract the lace 23. Preferably, the gear mechanism is configured to incrementally pull and retain a predetermined length of lace as the knob 62 is rotated, as described in detail below. A user may thus advantageously continuously adjust the tension in the lace 23 to a desired comfort and performance level. The knob 62 may be rotated either manually or through the use of a tool or small motor attached to the knob 62.

Any of a variety of known mechanical structures can be utilized to permit winding of the spool to increase tension on the lace, yet resist unwinding of the spool until desired. For example, any of a wide variety of ratchet structures can be used for this purpose. Alternatively, a sprague clutch or similar structure will permit one-way rotation of a shaft while resisting rotation in the opposite direction. These and other structures will be well known to those of ordinary skill in the mechanical arts.

A release lever 63 is located along a side of the housing 60. The release lever may be rotated to disengage the internal gear mechanism to release tension in the lace 23 and loosen the upper 23 around the wearer's foot, as described in detail below. This advantageously allows a user to quickly and easily untighten the lacing system by simply turning the release lever 63.

The low friction relationship between the lace 23 and cable guides 50, 52 greatly facilitate tightening and untightening of the lacing system 20. Specifically, because the lace 23 and cable guides 50 and 52 are manufactured or coated with a low friction material, the lace 23 slides easily through the cable guides without catching. The lace 23 thus automatically distributes the tension across its entire length so that tightening pressure is evenly distributed along the length of the ankle and foot. When the tension in the lace 23 is released by actuating the release lever, the lace 23 slides easily through the cable guides 50 and 52 to release tension and evenly distribute any slack among the length of the lace. The low friction tongue 36 also facilitates moving of the flaps 32, 34 away from each other when the lace 23 is loosened.

Figure 4:
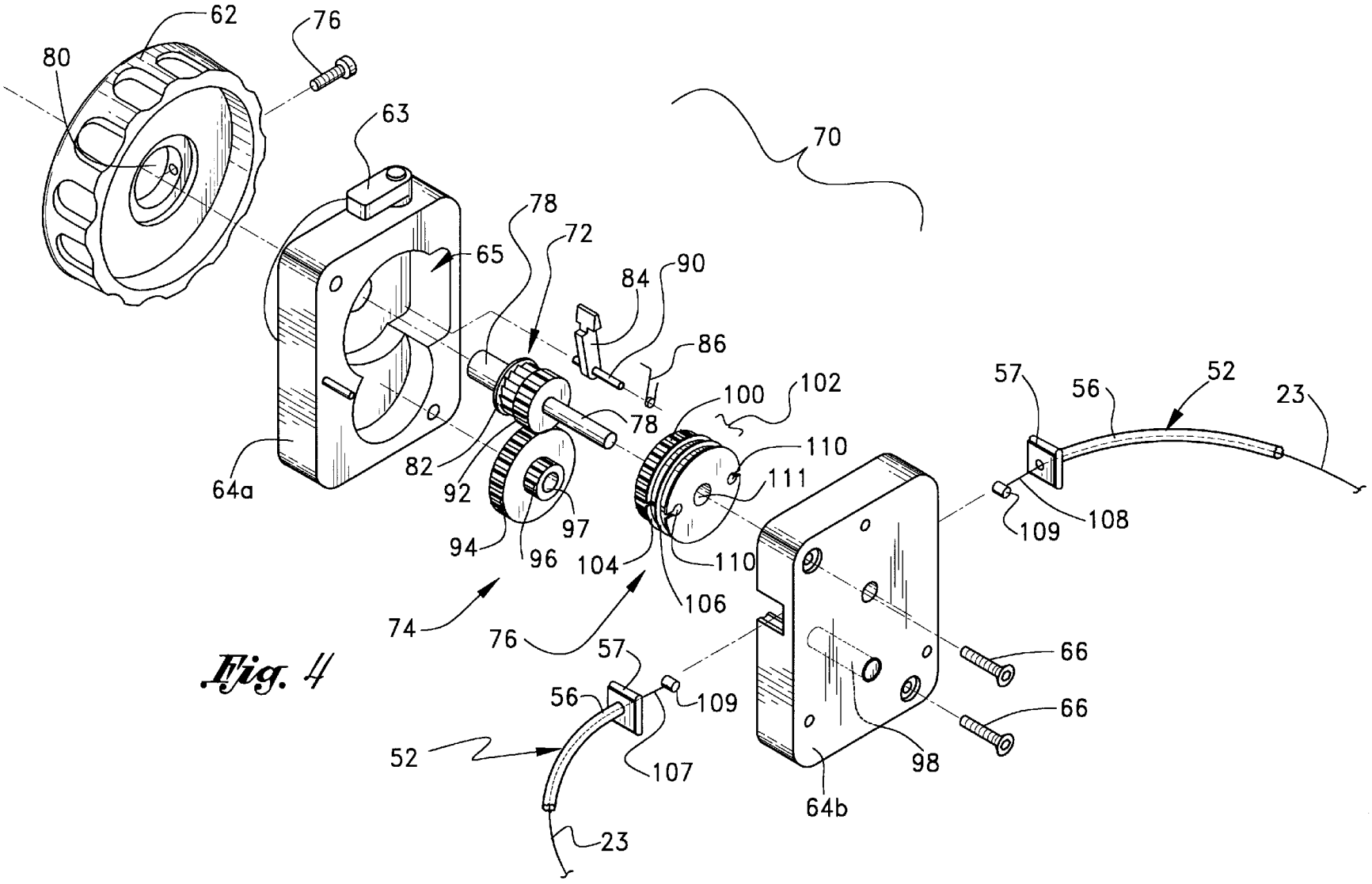
FIG. 4 is an exploded perspective view of one embodiment of a tightening mechanism used with the lacing system described herein.

FIG. 4 is an exploded perspective view of the various components of one embodiment of the tightening mechanism 25. As shown, the housing 60 consists of a pair of interlocking halves 64*a* and 64*b* that are mated to each other using fasteners 66, such as screws. The housing 60 encloses a gear mechanism 70 that preferably rotatably fits within cavities 65 in the inner surfaces of the halves 64*a* and 64*b*. In the illustrated embodiment, the gear mechanism 70 comprises first, second, and third gear wheels 72, 74, and 76, respectively, that rotatably engage with each other when the tightening mechanisms 25 is assembled.

As shown in FIG. 4, the first gear wheel 72 includes a shaft 78 about which the first gear wheel rotates. A first portion of the shaft 78 extends through an aperture in the housing halve 64*a*. A second portion of the shaft 78 extends through an aperture in the halve 64*b*. The knob 62 mounts to the shaft 78 through a mounting hole 80 in the knob 62. A mounting pin 76 removably secures the knob 62 to the shaft 78 in a well known manner. When the tightening mechanism 25 is assembled, rotation of the knob 62 causes the first gear wheel 72 to also rotate. Actuation of the gear mechanism 70 is thus accomplished through rotation of the knob 62.

Referring to FIG. 4, the first gear wheel 72 also includes a ratchet section 82 having a plurality of sloped teeth 83 (FIG. 6) positioned circumferentially around the axis of the first gear wheel 72. The sloped teeth 83 are configured to mate with a pawl 84 to prevent undesired backward rotation of the first gear wheel 72, as described more fully below. Toward this end, a biasing member 86 couples to a peg 90 that extends from the pawl 84. The biasing member 86 biases the pawl 84 against the ratchet teeth when the gear mechanism 70 is assembled. The first gear wheel 72 also includes a gear section 92 having a series of gear teeth that extend around the periphery of the first gear wheel 72.

As shown in FIG. 4, the second gear wheel 74 includes a first gear section 94 and a stepped second gear section 96 having a diameter smaller than the first gear section 94 on a common axis of rotation. The first gear section 94 has gear teeth that are configured to mesh with the gear section 92 of the first gear wheel 72. An aperture 97 extends centrally through the second gear wheel 74. The aperture 97 is sized to rotatably receive a post 98 that extends from the housing halve 64*b*. The second gear wheel 74 rotates about the post 98 during actuation of the assembled gear mechanism 70.

Referring to FIG. 4, the third gear wheel 76 includes a gear section 100 that is configured to mesh with the second gear section 96 of the second gear wheel 74. The third gear wheel also includes a spool section 102 comprising grooves 104, 106 that extend around the periphery of the third gear wheel 76. The grooves 104, 106 are sized to receive opposite ends of the lace 23 in a winding fashion during actuation of the gear mechanism 25.

The ends 107 and 108 of the lace 23 are each provided with anchors 109 that mate with seating holes 110 in a press fit fashion. The seating holes 110 are diametrically positioned on the third gear wheel 76. When the anchors 109 are mated with the seating holes 110, the ends 107 and 108 of the lace 23 are separately positioned within the grooves 104 and 106, respectively. The coupling mounts 57 fit into a corresponding aperture in the housing halve 64 to maintain the distal ends 56 of the guide member 50 in a fixed position relative to the tightening mechanism.

Any of a variety of spool or reel designs can be utilized in the context of the present invention, as will be apparent to those of skill in the art in view of the disclosure herein. For example, only a single groove spool can be utilized. However, a dual groove spool or two side-by-side spools as illustrated has the advantage of permitting convenient simultaneous retraction of both lace ends 107 and 108. In the illustrated embodiment, with ends 107 and 108 approaching the spool from opposite directions, the lace conveniently wraps around the spool in opposite directions using a single rotatable shaft as will be apparent from FIG. 4.

Depending upon the gearing ratio and desired performance, one end of the lace can be fixed to a guide or other portion of the boot and the other end is wound around the spool. Alternatively, both ends of the lace can be fixed to the boot, such as near the toe region and a middle section of the lace is attached to the spool.

Preferably, the cavity 65 is toleranced to fit closely around the outer circumference of the spool, to capture the lace. Thus, the gap between the outer flange walls surrounding each groove and the interior surface of the cavity 65 are preferably smaller than the diameter of the lace. In this manner, the risk of tangling the lace within the winding mechanism can be minimized.

Any of a variety of attachment structures for attaching the ends of the lace to the spool can be used. In addition to the illustrated embodiment, the lace may conveniently be attached to the spool by threading the lace through an aperture and providing a transversely oriented set screw so that the set screw can be tightened against the lace and to attach the lace to the spool. The use of set screws or other releasable clamping structures facilitates disassembly and reassembly of the device, and replacement of the lace as will be apparent to those of skill in the art.

Rotation of the third gear wheel 76 causes the ends 107 and 108 of the lace 23 to wind around the grooves 104 and 106, respectively, and thereby pull the length of the lace 23 into the tightening mechanism 25 and place the lace 23 in tension. It is understood that the ends 107, 108 of the lace 23 wind around the spool section 102 at an equal rate so that tension is evenly applied to both ends of the lace 23.

The third gear wheel includes a central aperture 111 sized to rotatably receive the shaft 78 on the first gear wheel 72. The third gear wheel 76 rotates about the shaft 78 during actuation of the gear mechanism 70.

In a preferred embodiment, the third gear wheel 76 has a diameter of 0.625 inches. The second gear section 96 of the second gear wheel 74 preferably has a diameter of approximately 0.31 inches and the first gear section preferably has a diameter approximately equal to the diameter of the third gear wheel 76. The first gear wheel 72 preferably has a diameter of approximately 0.31 inches. Such a relationship in the gear sizes provides sufficiently small adjustments in the tension of the lace 23 as the gear wheels are turned.

Figure 5:
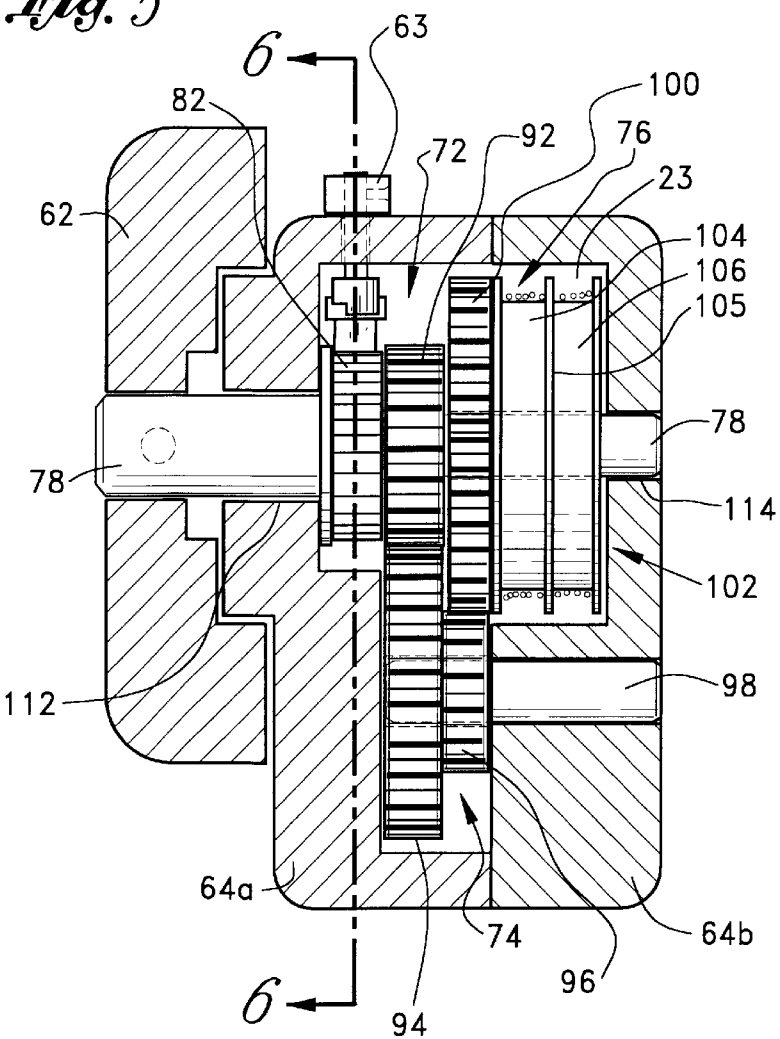
FIG. 5 is a cross-sectional side view of the assembled tightening mechanism of FIG. 4.

FIG. 5 illustrates a cross-sectional view of the assembled tightening mechanism 25. As shown, the shaft 78 of the first gear wheel 72 is journaled within apertures 112 and 114 in the housing halves 64*a* and 64*b*, respectively. The knob 62 is mounted over the portion of the shaft 78 extending out of the halve 64*a* through the aperture 112. The first, second, and third gear wheels 72, 74, and 76, respectively are in meshed engagement with each other. Specifically, the gear section 92 of the first gear wheel 72 is in meshed engagement with the first gear section 94 on the second gear wheel. Likewise, the second gear section 96 on the second gear wheel 94 is in meshed engagement with the gear section 100 of the third gear wheel 76. Accordingly, rotation of the knob 62 causes the first gear wheel 72 to rotate and thereby cause the second gear wheel to rotate in an opposite direction by means of the meshed engagement between the gear sections 92 and 94. This in turn causes the third gear wheel 76 to rotate in the direction of knob rotation by means of the meshed engagement between the gear sections 96 and 100.

As the third gear wheel 76 rotates, the ends 107 and 108 of the lace are wound within the grooves 104 and 106 respectively. Rotation of the knob 62 thus winds the lace 23 around the third gear wheel 76 to thereby tighten the boot 20.

As illustrated, counterclockwise rotation (relative to FIG. 6) of the knob 62 tightens the lace 23. The tension in the lace 23 is maintained by means of a ratchet mechanism that is described with reference to FIG. 6.

Figure 6:
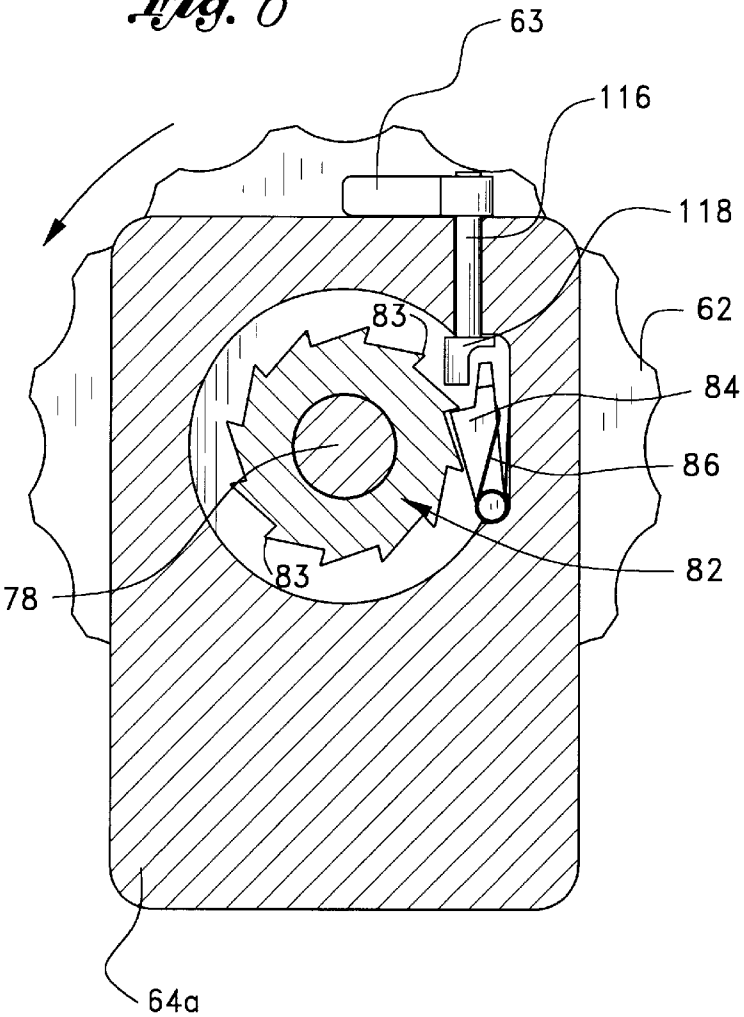
FIG. 6 is a cross-sectional view of the tightening mechanism of FIG. 5 taken along the line 6—6.

FIG. 6 is a cross-sectional view of the tightening mechanism 25 taken along the line 6—6 of FIG. 5. As shown, the biasing member 86 maintains the pawl 84 in locked engagement with the sloped teeth 83 on the ratchet section 82. The pawl 84 thus inhibits clockwise rotation of the knob 62 and loosening of the lace 23. It will be understood that the sloped teeth 83 do not inhibit counterclockwise rotation of the knob 62 because the pawl 84 slides over the teeth 83 when the knob 64 is rotated clockwise. As the knob 62 is rotated counterclockwise, the pawl 84 automatically engages each of the teeth 83 to advantageously allow the user to incrementally adjust the amount of lace 23 that is drawn into the tightening mechanism 25.

As shown in FIG. 6, the release lever 63 communicates with the pawl 84 through a shaft 116 that extends through the housing 60. A lower end of the shaft 116 is provided with a cam member 118. The release lever 63 may be rotated about the shaft 116 to cause the cam member 118 to also rotate and push the pawl 84 away from engagement with the ratchet teeth 83. When the pawl 84 disengages from the ratchet teeth, the first gear wheel 72, and each of the other gear wheels 74 and 76, are free to rotate.

When the user actuates the release lever 63, the tension, if any, in the lace 23 causes the lace 23 to automatically unwind from the spooling section 102. The release lever 63 is thus used to quickly untighten the boot 20 from around the foot. It will be appreciated that the low friction relationship between the lace 23 and the guide members 50 and 52 facilitates sliding of the lace 23 within the guide members so that the lace untightens quickly and smoothly by simply turning the release lever 63 and then manually pulling the tongue 36 forward.

It is contemplated that the resistance to expansion applied by the lace 23 could be supplemented, such as through straps that extend transversely across the boot 20 at locations where increased tightness or support are desired. For instance, a strap could extend across the instep portion 30 from one side of the boot 20 to another side of the boot. A second or lone strap could also extend around the ankle portion 29. Any of a wide variety of well known mechanisms could be used to adjust and maintain the tightness of the straps, such as snaps, buckles, clamps, hook and loop fasteners and the like.

The footwear lacing system 20 described herein advantageously allows a user to incrementally tighten the boot 20 around the user's foot. The low friction lace 23 combined with the low friction guide members 50, 52 produce easy sliding of lace 23 within the guide members 50 and 52. The low friction tongue 36 facilitates opening and closure of the flaps 32 and 34 as the lace is tightened. The lace 23 equilibrates tension along its length so that the lacing system 23 provides an even distribution of tightening pressure across the foot. The tightening pressure may be incrementally adjusted by turning the knob on the tightening mechanism 25. A user may quickly untighten the boot 20 by simply turning the release lever 63 to automatically release the lace 23 from the tightening mechanism 25.

Although the present invention has been described in terms of certain preferred embodiments, other embodiments can be readily devised by one with skill in the art in view of the foregoing, which will also use the basic concepts of the present invention. Accordingly, the scope of the present invention is to be defined by reference to the following claims.

What is claimed is:

1. A closure system for footwear having an upper, with a lateral side and a medial side, the closure system comprising:

a first lace guide attached to the lateral side of the upper;

a second lace guide attached to the medial side of the upper;

each of the first and second lace guides comprising a longitudinal lace pathway extending generally parallel to a longitudinal axis of the footwear and first and second transverse guide surfaces;

a lace slidably extending along the first and second transverse guide surfaces and longitudinal lace pathway of each of the first and second lace guides; and a tightening mechanism on the footwear, for retracting the lace, thereby advancing the first lace guide towards the second lace guide to tighten the footwear.

2. A closure system for footwear as in claim 1, wherein each of the first and second transverse guide surfaces has a length within the range of from about ⅛th inch to about 1 inch.

3. A closure system for footwear as in claim 2, wherein the longitudinal lace pathway on each of the first and second lace guides has a length within the range of from about ½ inch to about 3 inches.

4. A closure system for footwear as in claim 1, further comprising a transition between each longitudinal lace pathway and each corresponding first and second transverse guide surfaces, said transition having a smooth curve.

5. A closure system for footwear as in claim 4, wherein the curve has a radius of greater than about 0.1 inches.

6. A closure system for footwear as in claim 1, wherein each of the first and second lace guides comprises a tube.

7. A closure system for footwear as in claim 1, wherein each of the first and second transverse guide surfaces has a length of at least about ⅛ inch.

8. A closure system for footwear as in claim 1, wherein each of the first and second transverse guide surfaces comprises a smooth curve.

9. A closure system for footwear as in claim 8, wherein the curve has a radius of at least about 0.1 inches.

10. A closure system for footwear as in claim 1, wherein the transverse guide surfaces comprise the interior surface of a tube.

* * * * *